US011346366B2

(12) United States Patent
Joly et al.

(10) Patent No.: US 11,346,366 B2
(45) Date of Patent: May 31, 2022

(54) ROTATING DIFFUSER IN CENTRIFUGAL COMPRESSOR

(71) Applicant: Carrier Corporation, Palm Beach Gardens, FL (US)

(72) Inventors: Michael M. Joly, Hebron, CT (US); Xiaodan Cai, Glastonbury, CT (US); Chaitanya V. Halbe, Manchester, CT (US); William T. Cousins, Glastonbury, CT (US); Vishnu M. Sishtla, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 99 days.

(21) Appl. No.: 16/778,729

(22) Filed: Jan. 31, 2020

(65) Prior Publication Data

US 2020/0256352 A1 Aug. 13, 2020

Related U.S. Application Data

(60) Provisional application No. 62/803,945, filed on Feb. 11, 2019.

(51) Int. Cl.

| | |
|---|---|
| ***F04D 29/44*** | (2006.01) |
| ***F04D 29/059*** | (2006.01) |
| ***F04D 17/10*** | (2006.01) |

(52) U.S. Cl.

CPC ..... *F04D 29/442* (2013.01); *F04D 17/10* (2013.01); *F04D 29/059* (2013.01); *F04D 29/444* (2013.01); *F05B 2240/12* (2013.01); *F05B 2240/50* (2013.01)

(58) Field of Classification Search

CPC .... F04D 29/056; F04D 29/059; F04D 29/442; F04D 29/444; F04D 29/447; F04D 29/448

See application file for complete search history.

(56) References Cited

U.S. PATENT DOCUMENTS 2,344,366 A * 3/1944 Price ..... F04D 25/02 415/64
3,150,650 A * 9/1964 Dreesen ..... F02C 6/12 123/559.1
3,197,124 A * 7/1965 Sallou ..... F04D 29/442 416/183

(Continued)

FOREIGN PATENT DOCUMENTS

CN 201330717 Y 10/2009
DE 2436458 A1 * 2/1975 ..... F04D 29/442
SU 1339302 A1 * 9/1987

OTHER PUBLICATIONS

Extended European Search Report; International Application No. 20156417.6-1007; International Filing Date: Feb. 10, 2020; dated Jun. 25, 2020; 56 pages.

*Primary Examiner* — Christopher R Legendre
(74) *Attorney, Agent, or Firm* — Cantor Colburn LLP

(57) ABSTRACT

A centrifugal compressor includes a shaft defining an axis, an impeller mounted to the shaft for rotation about the axis, and a diffuser section including a first wall, a second wall, and an opening defined between the first wall and the second wall. The opening of the diffuser section is arranged in fluid communication with the impeller. The first wall is rotatable about the axis and rotation of the first wall about the axis is mechanically driven.

16 Claims, 6 Drawing Sheets

(56) References Cited

U.S. PATENT DOCUMENTS

| | | | | |
|---|---|---|---|---|
| 3,378,229 | A * | 4/1968 | Erwin | F04D 29/442 415/148 |
| 3,460,748 | A * | 8/1969 | Erwin | F04D 29/442 415/98 |
| 3,521,635 | A | 7/1970 | Koehn | |
| 3,868,196 | A | 2/1975 | Lown | |
| 3,941,501 | A | 3/1976 | Shank | |
| 4,455,121 | A * | 6/1984 | Jen | F01D 9/00 415/143 |
| 5,323,612 | A * | 6/1994 | Werner | F02C 3/113 60/605.1 |
| 5,895,204 | A | 4/1999 | Sishtla et al. | |
| 5,899,661 | A | 5/1999 | Sishtla et al. | |
| 5,988,977 | A | 11/1999 | Gallagher et al. | |
| 6,015,259 | A | 1/2000 | Sishtla et al. | |
| 6,099,168 | A | 8/2000 | Sishtla | |
| 6,506,011 | B1 | 1/2003 | Sishtla | |
| 6,554,567 | B2 | 4/2003 | Sishtla | |
| 6,712,588 | B1 * | 3/2004 | Ribaud | F01D 9/048 415/224.5 |
| 9,097,258 | B2 * | 8/2015 | Hofer | F04D 17/127 |
| 9,347,450 | B2 * | 5/2016 | Wang | F04D 25/0606 |
| 2004/0154309 | A1 * | 8/2004 | Bernard | F04D 29/442 60/805 |
| 2016/0245159 | A1 * | 8/2016 | Kemmerling | F04D 29/442 |
| 2020/0256352 | A1 * | 8/2020 | Joly | F04D 17/10 |

* cited by examiner

A-A

ROTATING DIFFUSER IN CENTRIFUGAL COMPRESSOR

CROSS-REFERENCE TO RELATED APPLICATIONS

This application claims the benefit of U.S. Provisional Application Ser. No. 62/803,945, filed Feb. 11, 2019, the disclosure of which is incorporated herein by reference in its entirety.

BACKGROUND

Exemplary embodiments disclosed herein relate generally to a centrifugal compressor, and more particularly, to a diffuser structure for use in a centrifugal compressor of a refrigeration system.

Existing centrifugal compressors typically include a power driven impeller through which an inflow of refrigerant is induced for radially outward flow into a diffuser. A diffuser of the compressor commonly includes an annular passage defined by a wall surface of a fixed plate axially spaced from a shaped wall surface of a shroud. The diffuser has an inlet end receiving the impeller outflow and an outlet end from which refrigerant is provided to a compressor volute that is circumferentially divergent for example. Kinetic energy is converted by the diffuser of the compressor into a static pressure rise within the diffuser. The stationary walls of the diffuser may cause high shear stress resulting in pressure losses that impair the performance of the compressor.

BRIEF DESCRIPTION

According to an embodiment, a centrifugal compressor includes a shaft defining an axis, an impeller mounted to the shaft for rotation about the axis, and a diffuser section including a first wall, a second wall, and an opening defined between the first wall and the second wall. The opening of the diffuser section is arranged in fluid communication with the impeller. The first wall is rotatable about the axis and rotation of the first wall about the axis is mechanically driven.

In addition to one or more of the features described above, or as an alternative, in further embodiments the first wall includes a plurality of pieces and at least one of the plurality of pieces is mechanically driven about the axis.

In addition to one or more of the features described above, or as an alternative, in further embodiments rotation of the first wall about the axis is mechanically driven by at least one of the impeller and the shaft.

In addition to one or more of the features described above, or as an alternative, in further embodiments rotation of the first wall about the axis is mechanically driven by a motor.

In addition to one or more of the features described above, or as an alternative, in further embodiments the second wall is stationary.

In addition to one or more of the features described above, or as an alternative, in further embodiments the second wall is rotatable about the axis.

In addition to one or more of the features described above, or as an alternative, in further embodiments the first wall is rotatable about the axis at a first speed and the second wall is rotatable about the axis at a second speed, the first speed being distinct from the second speed.

In addition to one or more of the features described above, or as an alternative, in further embodiments the first wall and the second wall are connected by at least one coupler.

In addition to one or more of the features described above, or as an alternative, in further embodiments the at least one coupler has an airfoil shape.

In addition to one or more of the features described above, or as an alternative, in further embodiments the second wall is freely rotatable about the axis.

In addition to one or more of the features described above, or as an alternative, in further embodiments the second wall is mechanically driven about the axis.

According to another embodiment, a centrifugal compressor includes a shaft defining an axis, an impeller mounted to the shaft for rotation about the axis, and a diffuser section including a first wall, a second wall, an opening defined between the first wall and the second wall. The opening of the diffuser section is arranged in fluid communication with the impeller. The first wall is rotatable about the axis, and rotation of the first wall about the axis is driven by engagement of a fluid flow within the opening and a surface of the first wall facing the opening.

In addition to one or more of the features described above, or as an alternative, in further embodiments the first wall includes a plurality of pieces and at least one piece of the plurality of pieces is driven about the axis by engagement of the fluid flow within the opening and a surface of the at least one piece of the first wall facing the opening.

In addition to one or more of the features described above, or as an alternative, in further embodiments the plurality of pieces includes at least a first piece and a second piece, the first piece being rotatable about the axis at a first speed and the second piece being rotatable about the axis at a second speed, the first speed being different than the second speed.

In addition to one or more of the features described above, or as an alternative, in further embodiments at least one of the plurality of pieces of the first wall is mechanically driven about the axis.

In addition to one or more of the features described above, or as an alternative, in further embodiments at least one of the plurality of pieces of the first wall is stationary.

In addition to one or more of the features described above, or as an alternative, in further embodiments comprising at least one coupling mechanism positioned between the first wall and an adjacent component of the centrifugal compressor to allow relative rotation between the first wall and the adjacent component.

In addition to one or more of the features described above, or as an alternative, in further embodiments the at least one coupling mechanism includes one of a bearing and a roller assembly.

In addition to one or more of the features described above, or as an alternative, in further embodiments the surface of the first wall facing the opening has a non-planar configuration.

In addition to one or more of the features described above, or as an alternative, in further embodiments the surface of the first wall facing the opening has at least one vane extending into the opening.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
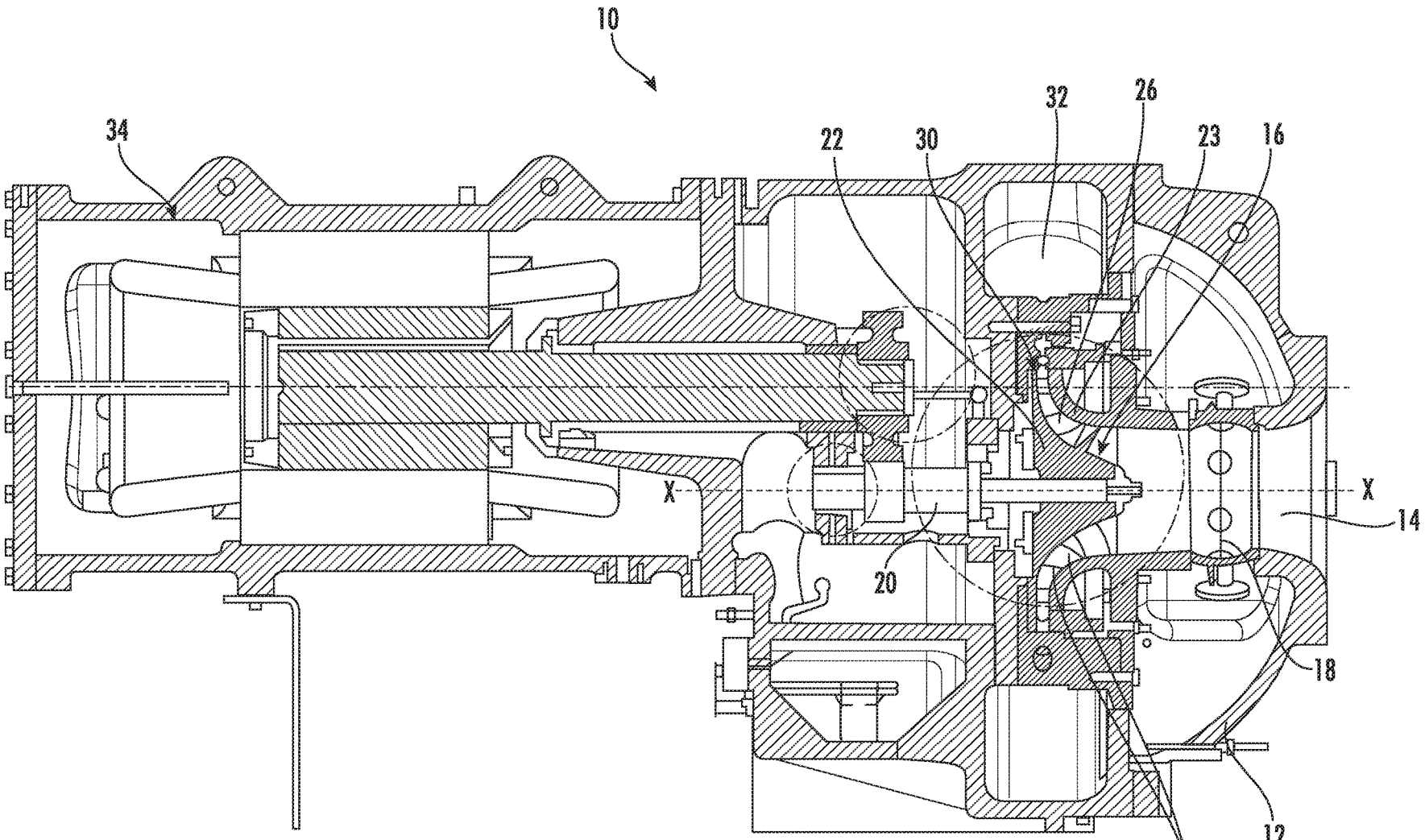
FIG. 1 is a cross-sectional view of a centrifugal compressor according to an embodiment.

Referring now to FIG. 1, an example of a centrifugal compressor 10 is illustrated. As shown, the centrifugal compressor 10 includes a housing 12 having an inlet 14 that directs refrigerant into a rotating impeller 16 through a series of adjustable inlet guide vanes 18. The impeller 16 is secured to a shaft 20 by any suitable means to align impeller 16 along the axis of the compressor 10. The impeller 16 includes a hub 22 supporting a plurality of blades 24. A plurality of passages 26 defined between adjacent blades 24 cause the incoming axial flow of a refrigerant fluid to turn in a radial direction and discharge the compressed refrigerant fluid from respective passages 26 into an adjacent diffuser section 30. The diffuser section 30 is generally circumferentially disposed about the impeller 16 and functions to direct the compressed refrigerant fluid into a toroidal-shaped volute 32, which directs the compressed fluid toward a compressor outlet, or alternatively, toward a second stage of the compressor 10, depending on the configuration of the compressor.

Figure 2:
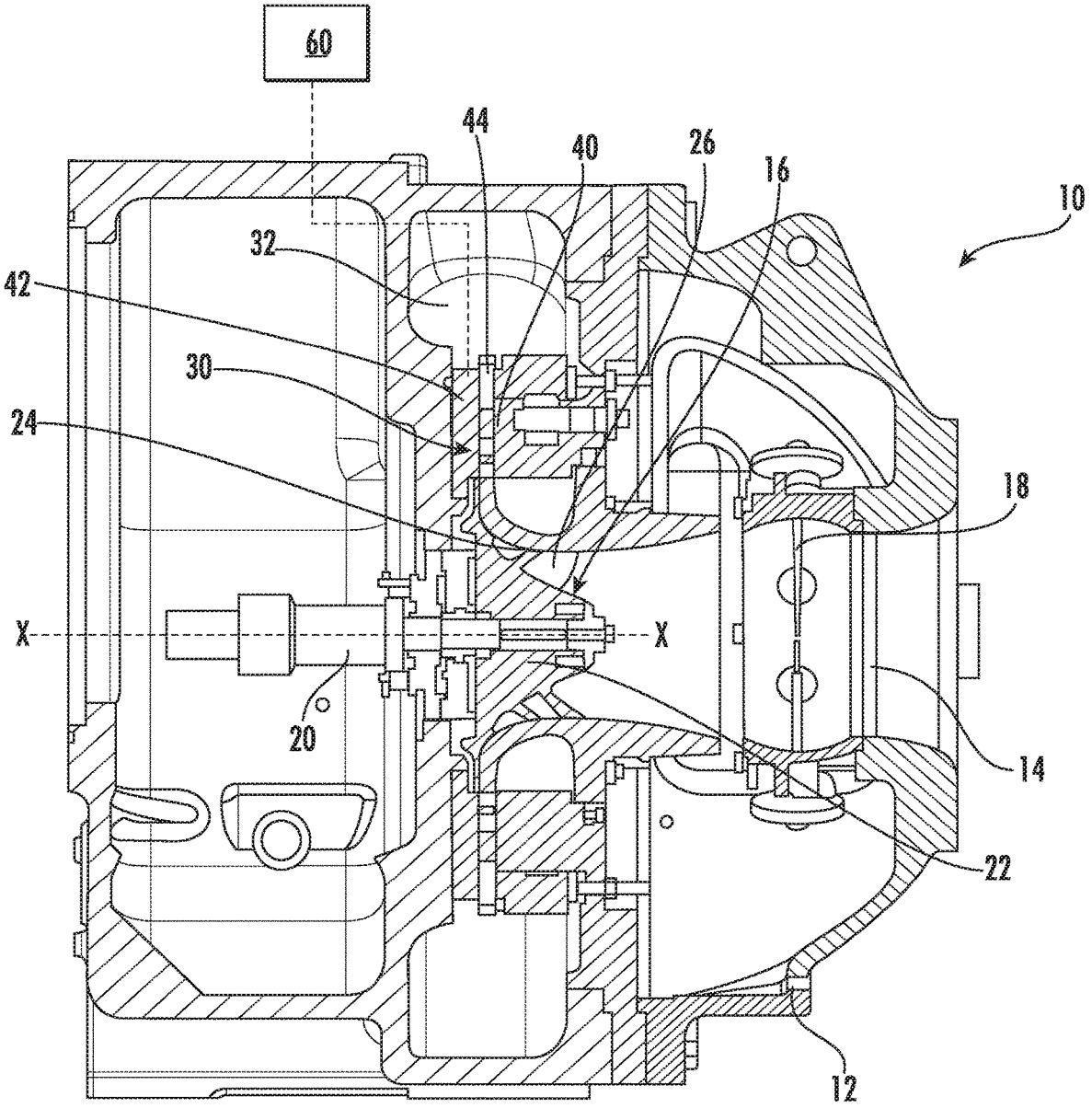
FIG. 2 is a cross-sectional view of a portion of a centrifugal compressor according to an embodiment.
Figure 3:
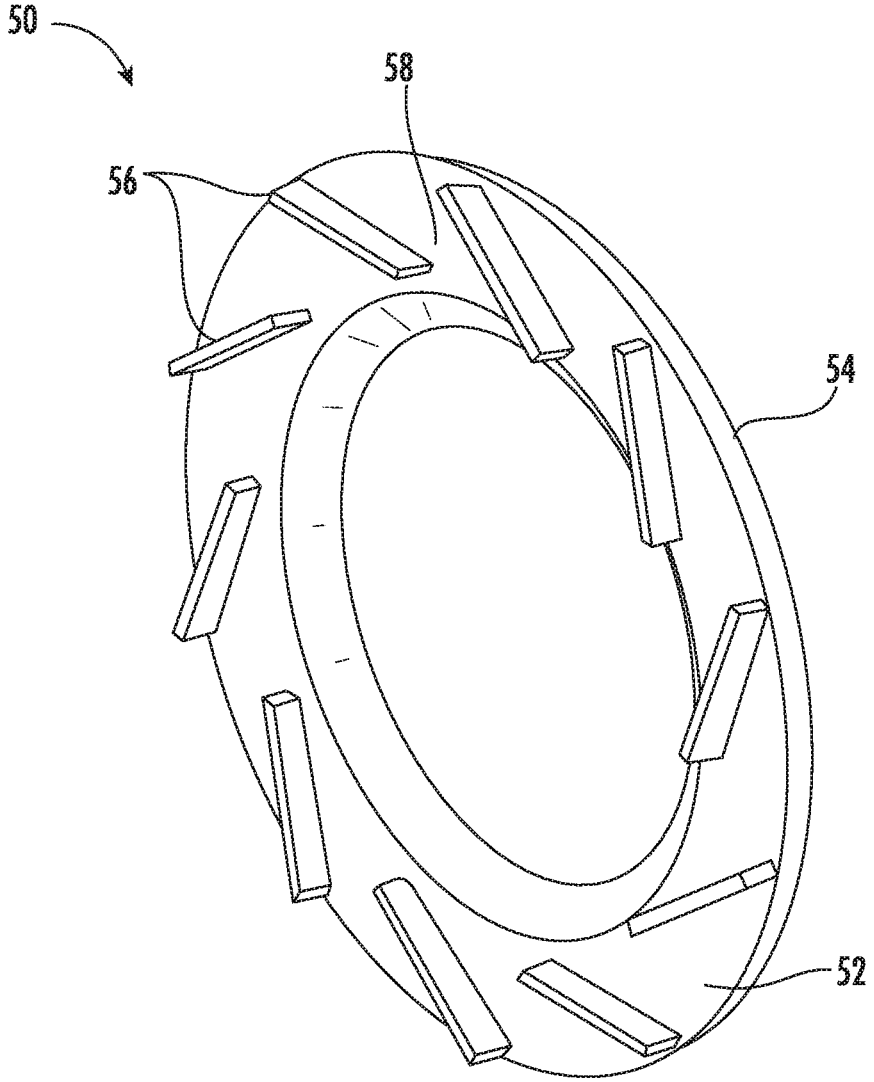
FIG. 3 is a perspective view of a wall of a diffuser section of a compressor according to an embodiment.
Figure 4B:
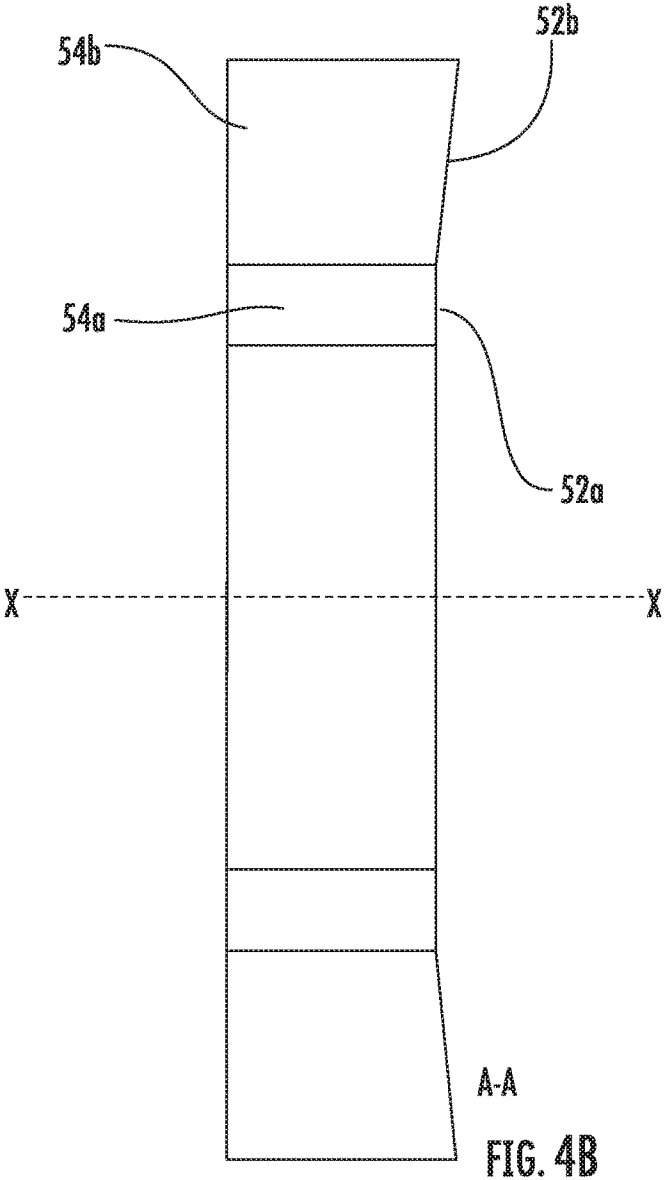
FIG. 4B is a cross-sectional view of the wall of the diffuser section of FIG. 4A compressor according to an embodiment.
Figure 4A:
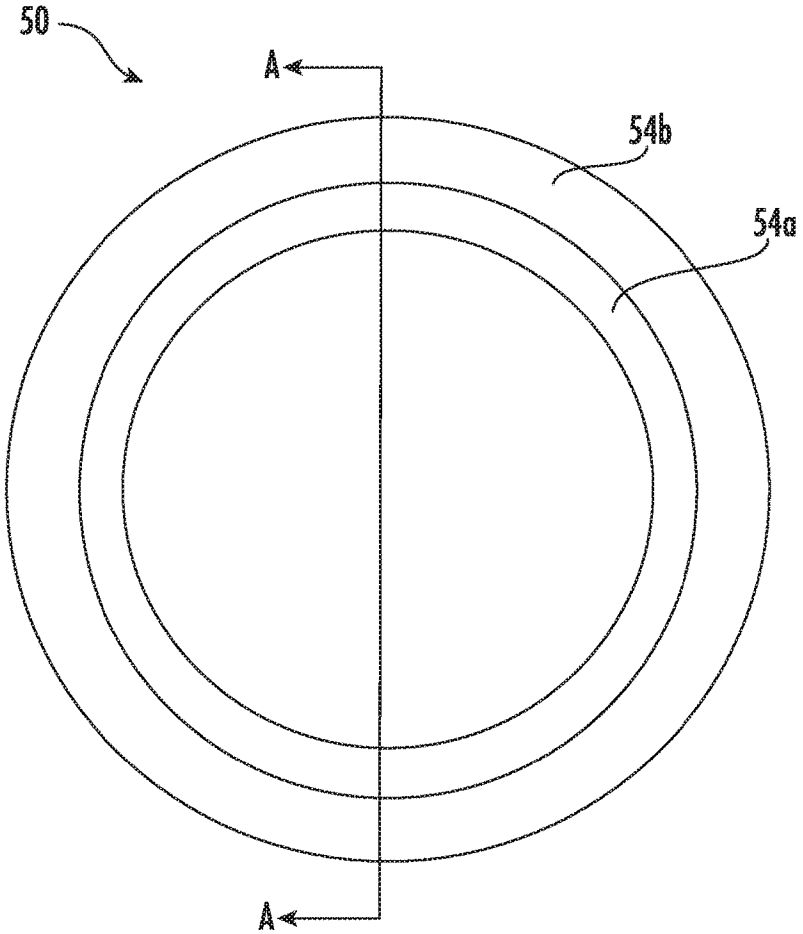
FIG. 4A is a front view of another wall of a diffuser section of a compressor according to an embodiment.
Figure 6A:
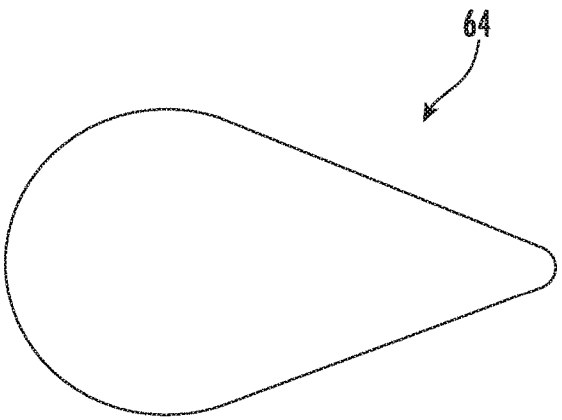
FIG. 6A is a cross-sectional view of a coupler of the diffuser section of FIG. 6 according to an embodiment.
Figure 6:
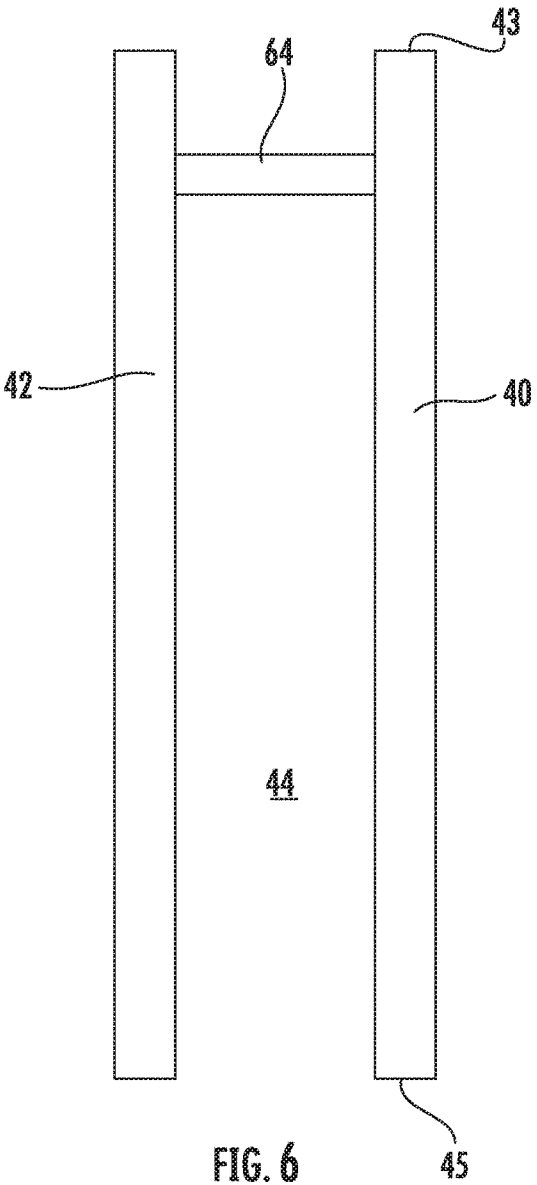
FIG. 6 is a detailed cross-sectional view of a diffuser section according to an embodiment.

As best shown in FIGS. 2 and 6, the diffuser section 30 typically includes a first wall 40, a second wall 42, and an opening 44 formed between the first and second walls 40, 42. The first wall 40 and the second wall 42 may be formed from any suitable material including a metal. The opening 44 is arranged in fluid communication with the radial flow discharged from the impeller 16. As shown, one or both of the first wall 40 and the second wall 42 has an outer edge 43 located near the volute 32 and an inner edge 45 positioned adjacent the impeller 16. An example of a wall 50, such as either the first wall 40 or the second wall 42 is illustrated in more detail in FIG. 3. In an embodiment, the wall 50 is disc-like in shape and has a substantially uniform thickness. Further, the surface 52 of the wall 50 configured to face the opening 44 may have a generally planar configuration. However, embodiments where the wall 50 has a non-uniform thickness and/or the surface 52 has a non-planar configuration (see FIGS. 4A and 4B) are also within the scope of the disclosure. Additionally, although the wall 50 in FIG. 3 is illustrated as being formed from a single piece, in other embodiments, such as shown in FIGS. 4A and 4B, the wall 50 may be formed from a plurality of pieces positioned adjacent one another. For example, the wall 50 may include a first piece 54*a* and a second piece 54*b* arranged concentrically with the first piece 54*a*. Although only two pieces are shown, embodiments where either wall 40, 42 is formed from any number of pieces 54 including more than two pieces are also within the scope of the disclosure. In embodiments where the wall 50 includes a plurality of pieces 54, the pieces 54 may be coupled together, such as via a fastener, adhesive, or another suitable coupling mechanism, or may be separate. Further, the pieces 54 may, but need not be identical in shape, size, thickness, and contour of the surface 52.

Referring again to FIG. 3, in the illustrated, non-limiting embodiment, the wall 50 includes a plurality of circumferentially spaced, fixed vanes 56, extending from the surface 52 toward the opening 44. The plurality of vanes 56 may be substantially identical, or alternatively, may vary in size, shape, and/or orientation relative to a central axis X of the compressor 10. As the refrigerant passes through the passageways 58 defined between adjacent vanes 56, the kinetic energy of the refrigerant may be converted to a potential energy or static pressure. However, it should be understood that embodiments where only one of the first and second wall 40, 42 includes vanes 56, or where neither the first wall 40 nor the second wall 42 has vanes 56 extending therefrom into the opening 44 are also within the scope of the disclosure.

At least a portion of the diffuser section 30, is rotatable about the axis X. More specifically, at least one of the first wall 40 and the second wall 42, or at least a portion of either wall 40, 42, such as one or more of the pieces 54 thereof for example, are rotatable about the axis X. In an embodiment, rotation of one or more walls 40, 42 of the diffuser section 30 may be driven by another component. For instance, at least a piece 54 of the first wall 40 and/or the second wall 42 may be coupled to a portion of the impeller 16, such as the hub 22 or a shroud 23, such that rotation of the wall 40, 42 is driven by the impeller 16. In embodiments where at least one of the walls 40, 42 is directly connected to the impeller 16, the at least one wall 40, 42 and the impeller 16 will rotate in unison, in the same direction and with the same velocity. Alternatively, the wall 40, 42 may be indirectly coupled to the impeller 16, such as via a gear train or other coupling mechanism. In such embodiments, the wall 40, 42, or a portion thereof, may be configured to rotate faster than the impeller, slower than the impeller, or at the same speed as the impeller. Although a wall is described as being coupled to the impeller 16, it should be understood that the wall 40, 42 or a piece 54 thereof may be coupled to any rotating component of the compressor 10, such as the shaft 20 for example.

In another embodiment, rotation of at least one of the first wall 40 and the second wall 42, or at least a piece 54 of either wall 40, 42, such as one or more of the pieces 54 thereof, may be driven by a motor, actuator, or other power driven component. The motor may be the same motor used to drive rotation of the shaft 20 about axis X, illustrated in FIG. 1 at 34, or alternatively, may be a separate motor, illustrated schematically at 60 in FIG. 2, located either within or external to the compressor housing 12. In an embodiment, the motor coupled to the rotating portion of the diffuser section 30 is a variable speed motor such that the rotational speed of the first wall 40 or second wall 42 coupled thereto may be adjusted, such as in response to one or more operating conditions of the compressor 10.

Figure 5A:
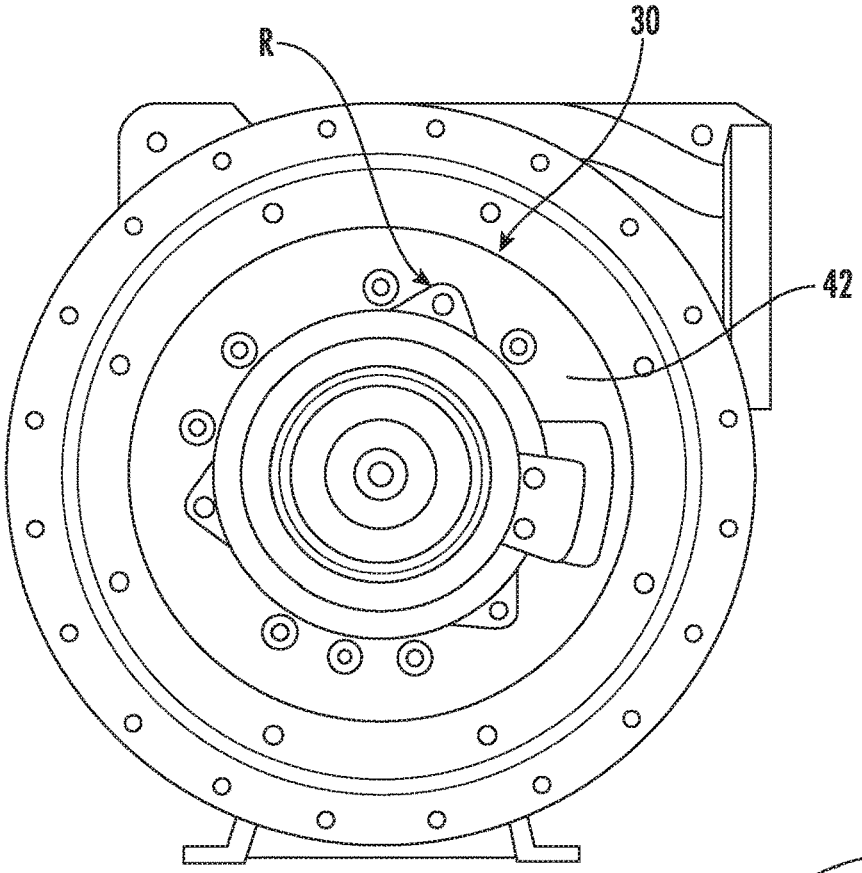
FIG. 5A is a front view of a portion of a diffuser section of a compressor according to an embodiment.
Figure 5B:
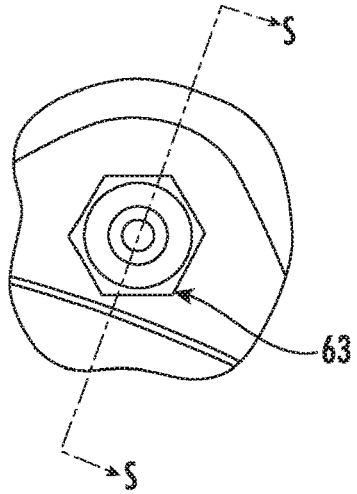
FIG. 5B is a detailed view of section R of FIG. 5A according to an embodiment.
Figure 5C:
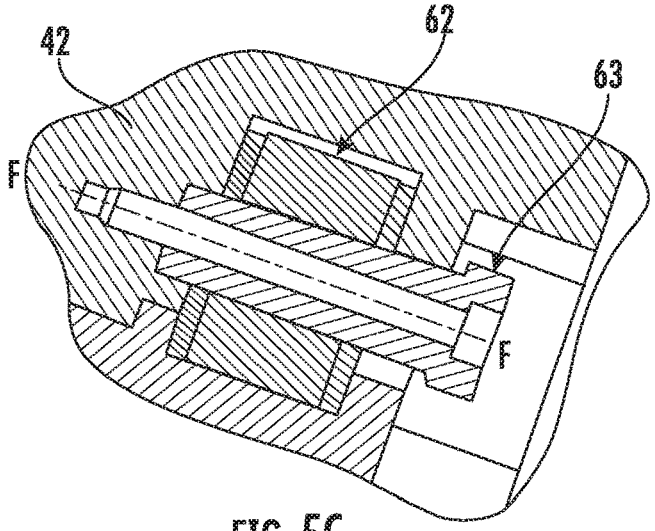
FIG. 5C is a cross-sectional view of section R of FIG. 5B according to an embodiment.

In yet another embodiment, at least one of the first wall 40, the second wall 42, or a piece 54 of either wall 40, 42, is configured to freely rotate about axis X. In such embodiments, rotation will be driven by the flow of refrigerant through the opening 44 of the diffuser section 30. To allow one or more pieces 54 of the first wall 40 or the second wall 42 to rotate freely, the freely rotatable pieces 54 are mounted to an adjacent portion of the compressor 10, such as the housing 12, impeller shroud 23, shaft 20, or another component coupled to the shaft 20, via at least one coupling mechanism 62 that allows for relative rotation there between. In the non-limiting embodiment illustrated in FIGS. 5A-5C, the coupling mechanism 62 includes a roller assembly. However, any suitable coupling mechanism 62, such as a bearing for example, is also within the scope of the disclosure. As shown, a plurality of roller assemblies 62 are positioned at the interface between a wall, such as wall 42 of the diffuser section 30, and an adjacent component, such as a portion of the impeller 16. In the illustrated, non-limiting embodiment, three roller assemblies 62 are arranged at the interface; however, it should be understood that embodiments including any number of roller assemblies 62, such as one, two, or more than three roller assemblies are also within the scope of the disclosure. As shown, a fastener 64 is used to couple each roller assembly 62 to the wall 42 of the diffuser section 30. Accordingly, the roller assembly 62 is rotatable about the respective axis F defined by the mounting fastener 63, to allow the adjacent wall 42 of the diffuser section 30 to rotate about axis X.

Embodiments where a single wall, either wall 40 or wall 42, has a piece 54*a* that is stationary and a second piece 54*b* that is rotatable about the axis X is within the scope of the disclosure. Further the wall may have a plurality of pieces, each of which is rotatable about the axis X at different speeds. Various configurations may be used to achieve these different rotational speeds. For example, a wall may have a piece 54 that is freely rotatable and another piece 54 that is rotatably driven by a component or motor. Alternatively, or in addition, one of the walls may have a piece 54 driven by a first component or motor, and another piece 54 driven by a second component or motor.

In addition, embodiments where at least a piece 54 of one wall is rotatable and at least a piece 54 of the other wall of the diffuser section 30 is stationary, or embodiments where at least a piece 54 of each of the first wall 40 and the second wall 40 are rotatable are within the scope of the disclosure. In embodiments where one or more pieces 54 of both the first wall 40 and the second wall 42 are rotatable, at least a piece 54 of one of the walls 40, 42 may be freely rotatable and at least a piece 54 of the other wall may be driven, at least a piece of both walls 40, 42 may be freely rotatable, or at least a piece of both of the walls 40, 42 may be driven.

With reference now to FIG. 6, in an embodiment, such as where a piece of one of the walls 40, 42 is rotatably driven and a piece of the other wall is freely rotatable, one or more couplers 64 may extend between the first wall 40 and the second wall 42. By including the couplers 64, the rotation of the driven piece 54 of one wall is transmitted to the freely rotatable piece 54 of the other wall. In an embodiment, the coupler 64 has an airfoil shape (see FIG. 6A) to minimize aerodynamic losses within the opening 44 of the diffuser section 30.

A rotating diffuser as illustrated and described herein improves the efficiency of the compressor stage relative to existing compressors having a stationary diffuser, such as by 3-5%.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A centrifugal compressor comprising:

a shaft defining an axis;

an impeller mounted to the shaft for rotation about the axis;

a diffuser section including a first wall, a second wall, and an opening defined between the first wall and the second wall, the opening of the diffuser section being arranged in fluid communication with the impeller, wherein during operation of the centrifugal compressor, both a portion of the first wall and a portion of the second wall are configured to rotate about the axis relative to each other, rotation of the portion of the first wall about the axis being mechanically driven, wherein the portion of the first wall is rotatable about the axis at a first speed and the portion of the second wall is rotatable about the axis at a second speed, the first speed being different from the second speed.

2. The centrifugal compressor of claim 1, wherein the first wall includes a plurality of pieces and the portion of the first wall that is rotatable includes at least one of the plurality of pieces.

3. The centrifugal compressor of claim 1, wherein rotation of the portion of the first wall about the axis is mechanically driven by at least one of the impeller and the shaft.

4. The centrifugal compressor of claim 1, wherein rotation of the portion of the first wall about the axis is mechanically driven by a motor.

5. The centrifugal compressor of claim 1, wherein the first wall includes at least a first piece and a second piece and the second wall includes at least a third piece and a fourth piece, the portion of the first wall including the first piece and the portion of the second wall including the third piece, wherein the second piece of the first wall and the fourth piece of the second wall are connected by at least one coupler.

6. The centrifugal compressor of claim 5, wherein the at least one coupler has an airfoil shape.

7. The centrifugal compressor of claim 1, wherein the portion of the second wall is freely rotatable about the axis.

8. The centrifugal compressor of claim 1, wherein the portion of the second wall is mechanically driven about the axis.

9. A centrifugal compressor comprisinges:

a shaft defining an axis;

an impeller mounted to the shaft for rotation about the axis;

a diffuser section including a first wall, a second wall, an opening defined between the first wall and the second wall, the opening of the diffuser section being arranged in fluid communication with the impeller, wherein during operation of the centrifugal compressor, both a portion of the first wall and the second wall are configured to rotate about the axis relative to each other, and rotation of the portion of the first wall about the axis is driven by engagement of a fluid flow within the opening and a surface of the first wall facing the opening, wherein the portion of the first wall is rotatable about the axis at a first speed and the second wall is rotatable about the axis at a second speed, the first speed being different from the second speed.

10. The centrifugal compressor of claim 9, wherein the first wall includes a plurality of pieces and the portion of the first wall that is rotatable about the axis includes at least one piece of the plurality of pieces.

11. The centrifugal compressor of claim 10, wherein the plurality of pieces includes at least a first piece and a second piece, the first piece being rotatable about the axis at a first speed and the second piece being rotatable about the axis at a third speed, the first speed being different than the third speed.

12. The centrifugal compressor of claim 10, wherein at least one of the plurality of pieces of the first wall is stationary.

13. The centrifugal compressor of claim 9, further comprising a bearing positioned between the portion of the first wall and an adjacent component of the centrifugal compressor to allow relative rotation between the portion of the first wall and the adjacent component.

14. The centrifugal compressor of claim 13, further comprising a roller assembly positioned between the portion of the first wall and the adjacent component of the centrifugal compressor to allow relative rotation between the portion of the first wall and the adjacent component.

15. The centrifugal compressor of claim 9, wherein the surface of the first wall facing the opening has a non-planar configuration.

16. The centrifugal compressor of claim 9, wherein the surface of the first wall facing the opening has at least one vane extending into the opening.

* * * * *